US008251492B2

(12) United States Patent
Kim et al.

(10) Patent No.: US 8,251,492 B2
(45) Date of Patent: Aug. 28, 2012

(54) DROPLET RECEIVER AND METHOD OF RECEIVING DROPLETS

(75) Inventors: Sang Jin Kim, Gyunggi-do (KR); Tae Yoon Kim, Seoul (KR); Young-Ho Cho, Daejeon (KR); Young Soo Oh, Gyunggi-do (KR); Bo Sung Ku, Gyunggi-do (KR); Sung Koo Kang, Gyunggi-do (KR)

(73) Assignee: Samsung Electro-Mechanics Co., Ltd., Suwon, Gyunggi-do (KR)

( * ) Notice: Subject to any disclaimer, the term of this patent is extended or adjusted under 35 U.S.C. 154(b) by 317 days.

(21) Appl. No.: 12/541,054

(22) Filed: Aug. 13, 2009

(65) Prior Publication Data

US 2010/0321450 A1 Dec. 23, 2010

(30) Foreign Application Priority Data

Jun. 18, 2009 (KR) ..... 10-2009-0054403

(51) Int. Cl.
*B41J 2/14* (2006.01)

(52) U.S. Cl. ..... 347/47

(58) Field of Classification Search ..... 347/74, 347/75, 65, 64, 61, 54, 56, 40, 42, 44, 47, 347/49, 20

See application file for complete search history.

(56) References Cited

U.S. PATENT DOCUMENTS

2002/0109755 A1* 8/2002 Meyer ..... 347/65
2007/0242106 A1* 10/2007 Shibata et al. ..... 347/64

FOREIGN PATENT DOCUMENTS

JP 63-242644 7/1998
JP 2001-150678 6/2001

OTHER PUBLICATIONS

Office Action from counterpart Korean Patent Application No. 10-2009-0054403, Apr. 1, 2011, 4 pages.

* cited by examiner

*Primary Examiner* — Kristal Feggins
(74) *Attorney, Agent, or Firm* — Blakely, Sokoloff, Taylor & Zafman, LLP

(57) ABSTRACT

Disclosed herein is a droplet receiver. The droplet receiver includes an internal space formed such that its sectional area is reduced towards an input part, thus preventing the rebounding of droplets which enter a droplet receiving part, and includes an intercepting fluid layer so as to isolate the received droplets from the outside, thus preventing droplets received in the droplet receiving part from being contaminated and volatilizing.

7 Claims, 8 Drawing Sheets

DROPLET RECEIVER AND METHOD OF RECEIVING DROPLETS

CROSS REFERENCE TO RELATED APPLICATION(S)

This application claims the benefit of Korean Patent Application No. 10-2009-0054403, filed on Jun. 18, 2009, entitled "DROPLET RECEIVER AND A METHOD OF RECEIVING DROPLETS", which is hereby incorporated by reference in its entirety into this application.

BACKGROUND OF THE INVENTION

1. Technical Field

The present invention relates to a droplet receiver and a method of receiving droplets.

2. Description of the Related Art

Ink used in industrial ink jet printing, for example, ink which is mainly used to pattern a wiring material, contains a volatile organic solvent. Hence, after printing is performed on a desired surface, the solvent volatilizes within a short period of time and only particles forming the wiring material are left. The particles are formed into wiring through sintering or the like.

However, in the case of ink used in a biology-related field, a reactant is dispersed in water and patterned on a surface with the ink. Subsequently, the reactant selectively reacts with a different reactant, so that a desired material is fixed to the surface or is selected. At this time, the volatilization of the ink lowers the reactivity and activity of the ink, so that the characteristics of the ink deteriorate.

Especially in the case of forming droplets and transmitting a minute amount of droplets to a chip through jetting or pipetting, a sample is apt to volatilize instantaneously or bounce off the target after the droplets are discharged.

SUMMARY OF THE INVENTION

The present invention has been made in an effort to provide a droplet receiver and a method of receiving droplets, which are capable of preventing the volatilization or rebounding of discharged droplets.

In a droplet receiver according to an embodiment of the present invention, a partition wall structure has an internal space for receiving a droplet and an input part for opening the internal space. An intercepting fluid layer is spaced apart from the bottom surface of the internal space in such a way as to be positioned inside or outside the internal space or to extend from an inside portion of the internal space to an outside portion thereof. A droplet receiving part defined by the internal space and the intercepting fluid layer is isolated from an outside by the intercepting fluid layer.

The internal space may be shaped such that a sectional area thereof is reduced towards the input part.

The intercepting fluid layer may be a gas layer or a liquid layer which has a flow.

The droplet receiver may further include a feed pipe connected at one end thereof to the droplet receiving part, thus providing a course within which the droplet received in the droplet receiving part moves.

The droplet receiver may further include a flow control unit which is installed at a predetermined position on the partition wall structure so as to control the flow of the intercepting fluid layer.

The droplet receiver may further include a fluid feeding unit which is provided on the feed pipe.

Further, in a method of receiving a droplet according to another embodiment of the present invention, a droplet receiver including a droplet receiving part which is isolated from an outside by an intercepting fluid layer which has a flow is provided. A droplet is discharged in a predetermined direction at a predetermined speed in consideration of a position of an input part of the droplet receiving part and a flow rate of the intercepting fluid layer so as to put the droplet into the droplet receiving part.

The above and other objects, features and advantages of the present invention will be more clearly understood from the following detailed description taken in conjunction with the accompanying drawings.

The terminologies or words used in the description and the claims of the present invention should not be interpreted as being limited merely to common or dictionary meanings. On the contrary, they should be interpreted based on the meanings and concepts of the invention in keeping with the scope of the invention on the basis of the principle that the inventor(s) can appropriately define the terms in order to describe the invention in the best way.

DESCRIPTION OF THE PREFERRED EMBODIMENTS

Figure 1:
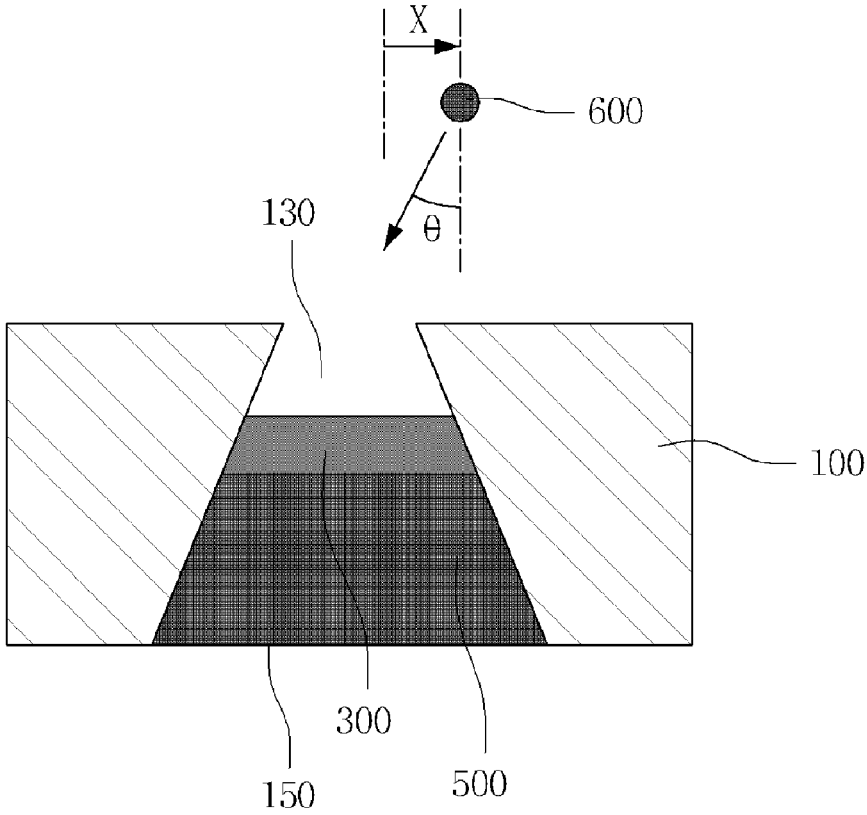
FIG. 1 is a sectional view illustrating a droplet receiver according to the preferred embodiment of the present invention.

Hereinafter, droplet receivers and methods of receiving droplets according to the preferred embodiments of the present invention will be described in detail with reference to the accompanying drawings. Reference now should be made to the drawings, in which the same reference numerals are used throughout the different drawings to designate the same or similar components, and the duplicate description of the components will be omitted. Herein, terms such as an upper portion or a lower portion are used to distinguish components from each other, and the components are not limited to the above terms.

FIG. 1 is a sectional view illustrating a droplet receiver according to the preferred embodiment of the present invention. As shown in the drawing, the droplet receiver according to this embodiment includes a partition wall structure 100 and an intercepting fluid layer 300. The partition wall structure 100 has an internal space 110 which receives droplets, and an input part 130 which functions to open the internal space 110. The intercepting fluid layer 300 isolates the received droplets from the outside.

The partition wall structure 100 is the external structure of the droplet receiver which defines the internal space 110 for receiving droplets. The material of the partition wall structure 100 is not limited to a specific material. That is, any material can be used for the partition wall structure 100 so long as it can receive liquid-phase droplets. Especially in the case where the droplet receiver is used in a biology-related field, the partition wall structure 100 is preferably made of a biocompatible material, for example, PDMS, PMMA, biocompatible plastics, or glass materials. More preferably, a surface treated layer for preventing the fixation of cells or a protein surface treated layer for the fixation of cells may be formed on the surface of the partition wall structure 100.

Figure 2:
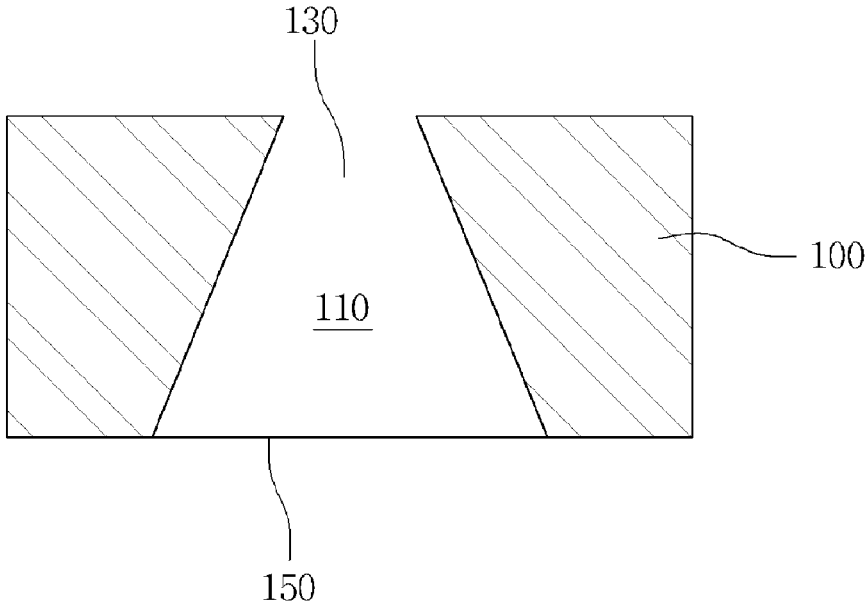
FIG. 2 is a sectional view illustrating the partition wall structure of the droplet receiver shown in FIG. 1.
Figure 11:
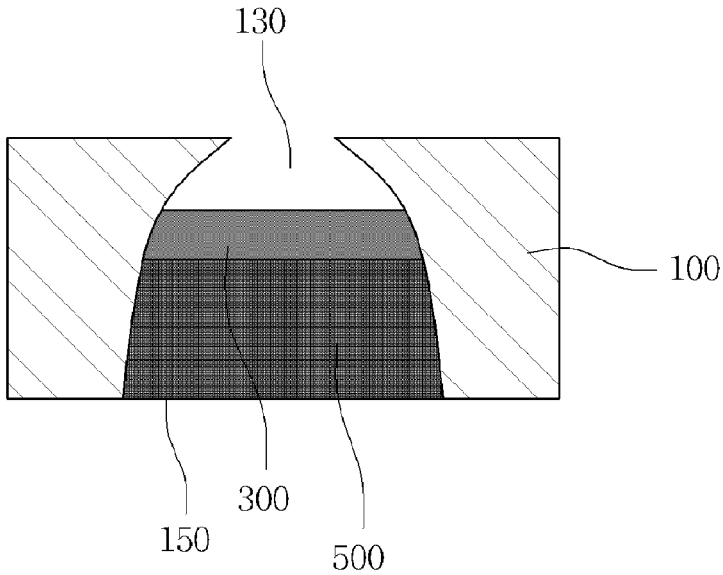
FIG. 11 is a sectional view illustrating a droplet receiver having a curved sidewall.

The internal space 110 is a cavity-shaped space which is formed in the partition wall structure 100. The input part 130 is provided in the upper portion of the partition wall structure 100 to open the internal space 110. Such an internal space 110 is designed to prevent the rebounding of the droplets which are put through the input part 130. FIG. 2 is a sectional view illustrating the internal space 110 which is formed in the partition wall structure 100 of the droplet receiver according to this embodiment. As shown in the drawing, the internal space 110 is shaped such that its sectional area is reduced towards the input part 130, thus effectively preventing the rebounding of the droplets. Here, the inclination angle of the sidewall of the internal space 110 may be adjusted. As shown in FIG. 11, the sidewall of the internal space 110 may be a curved surface having a radius of curvature.

Figure 3:
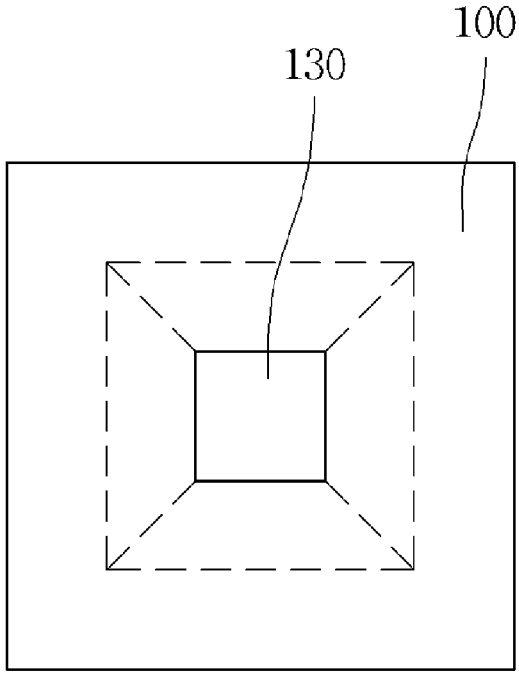
FIG. 3 is a plan view illustrating a partition wall structure having a rectangular cross-section.
Figure 4:
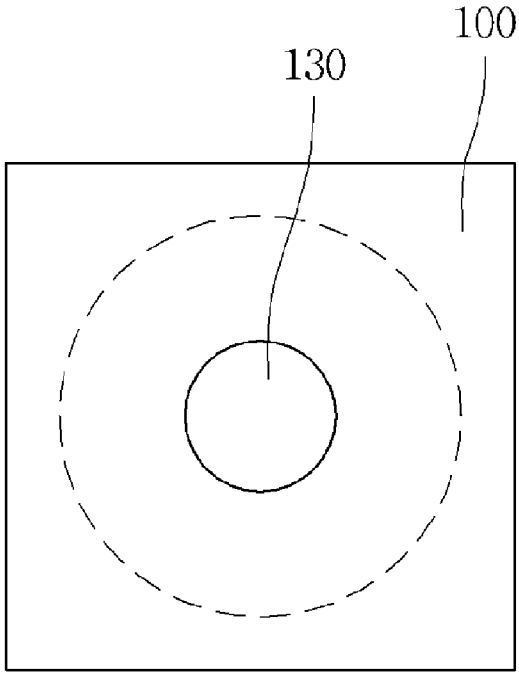
FIG. 4 is a plan view illustrating a partition wall structure having a circular cross-section.

The internal space 110 is not limited to a specific shape. FIGS. 3 and 4 are plan views of partition wall structures 100. As shown in the drawings, the internal space 110 may have a rectangular or circular cross-section.

Figure 5:
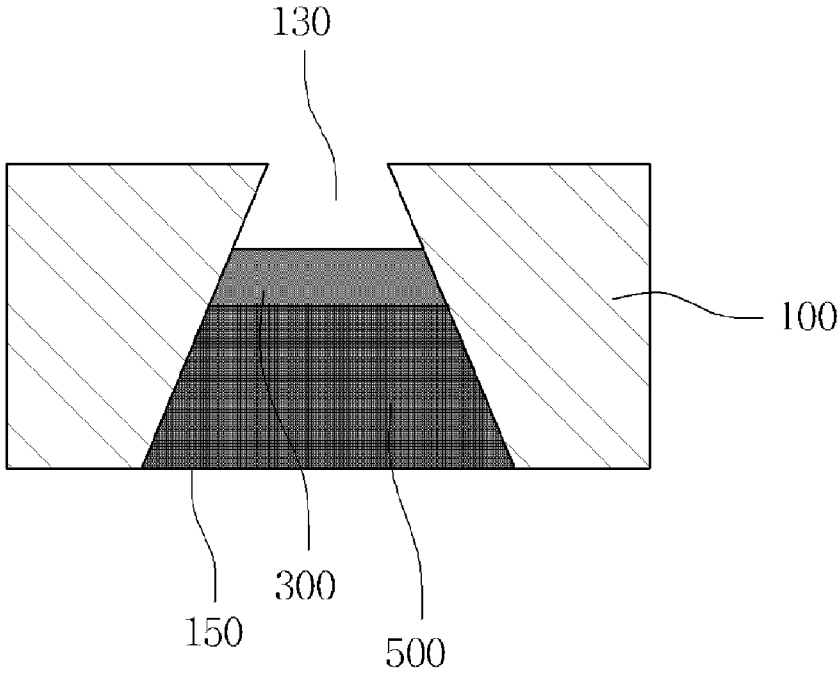
FIG. 5 is a sectional view illustrating a droplet receiver having an intercepting fluid layer inside an internal space.
Figure 6:
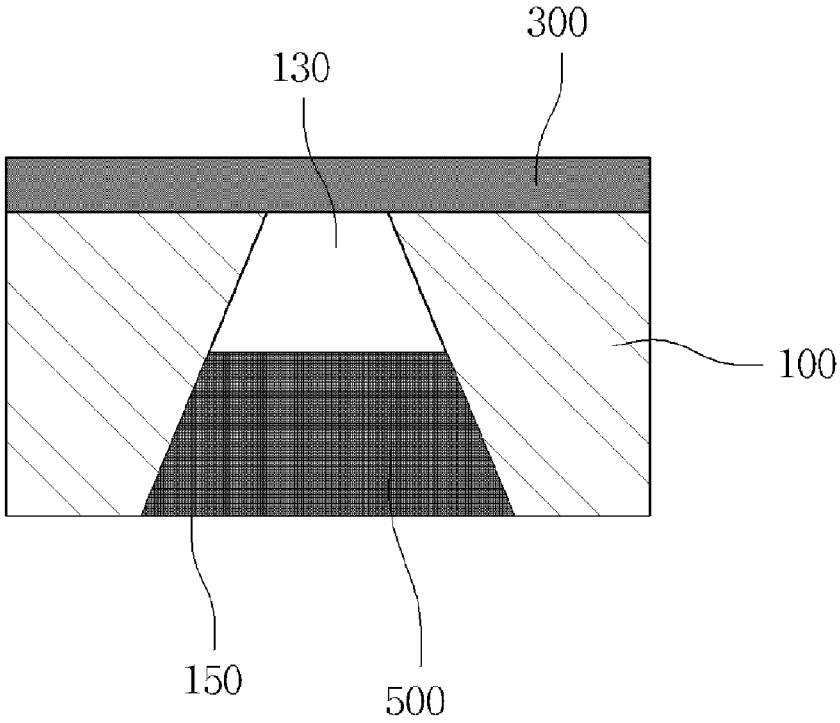
FIG. 6 is a sectional view illustrating a droplet receiver having an intercepting fluid layer outside an internal space.
Figure 7:
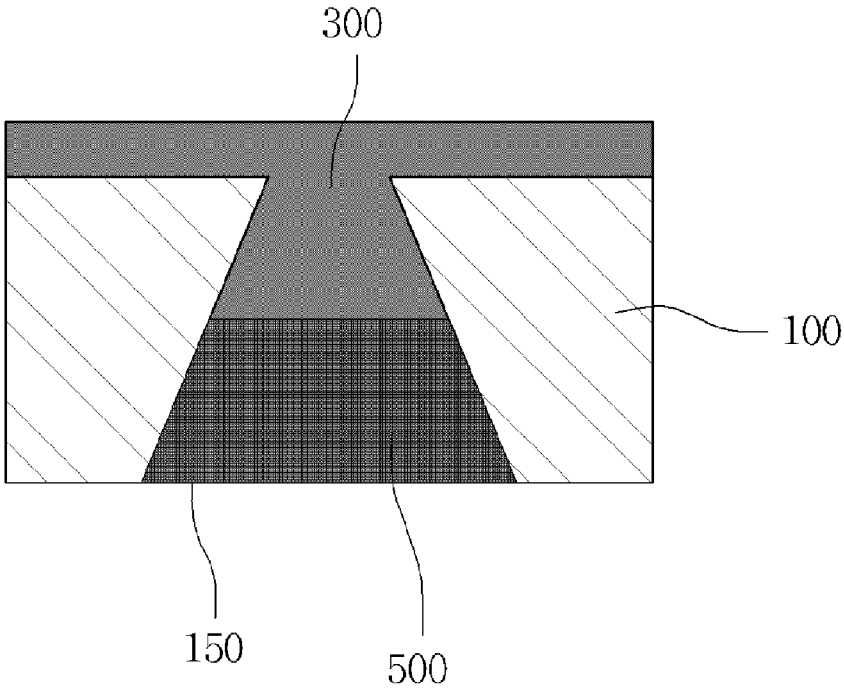
FIG. 7 is a sectional view illustrating a droplet receiver having an intercepting fluid layer which extends from the inside of an internal space to the outside thereof.

The intercepting fluid layer 300 is spaced apart from the bottom surface 150 of the internal space 110 so that the droplets are isolated from the outside. The intercepting fluid layer 300 is provided inside or outside the internal space 110 or extends from the inside portion of the internal space 110 to the outside portion thereof. FIG. 5 is a sectional view illustrating a droplet receiver, the intercepting fluid layer 300 of which is positioned inside the internal space 110, FIG. 6 is a sectional view illustrating a droplet receiver, the intercepting fluid layer 300 of which is positioned outside the internal space 110, and FIG. 7 is a sectional view illustrating a droplet receiver, the intercepting fluid layer 300 of which extends from the inside portion of the internal space 110 to the outside portion thereof. The intercepting fluid layer 300 is a layer of flowing liquid or gas. Gas or liquid forming the intercepting fluid layer 300 is not limited to a specific kind of gas or liquid, as long as the gas or liquid is an un-reactive substance which does not react with the droplets received in the droplet receiving part 500.

All or some of the internal space 110 is isolated from the outside by the intercepting fluid layer 300, and the droplets which are input are received in a space which is isolated from the outside. A space for receiving the droplets in the internal space 110 is referred to as a droplet receiving part 500. The intercepting fluid layer 300 is a kind of fluid curtain, and the droplet receiving part 500 defined by the intercepting fluid layer 300 is isolated from the outside. Thus, the intercepting fluid layer 300 prevents the droplets received in the droplet receiving part 500 from being dried during movement. Especially when the droplet receiver is applied to a field related to bio-chips, the volatilization of a sample which is accumulated in a bio-chip having the droplet receiving part 500 is prevented, thus maintaining the reactivity and activity of biomass.

Figure 8:
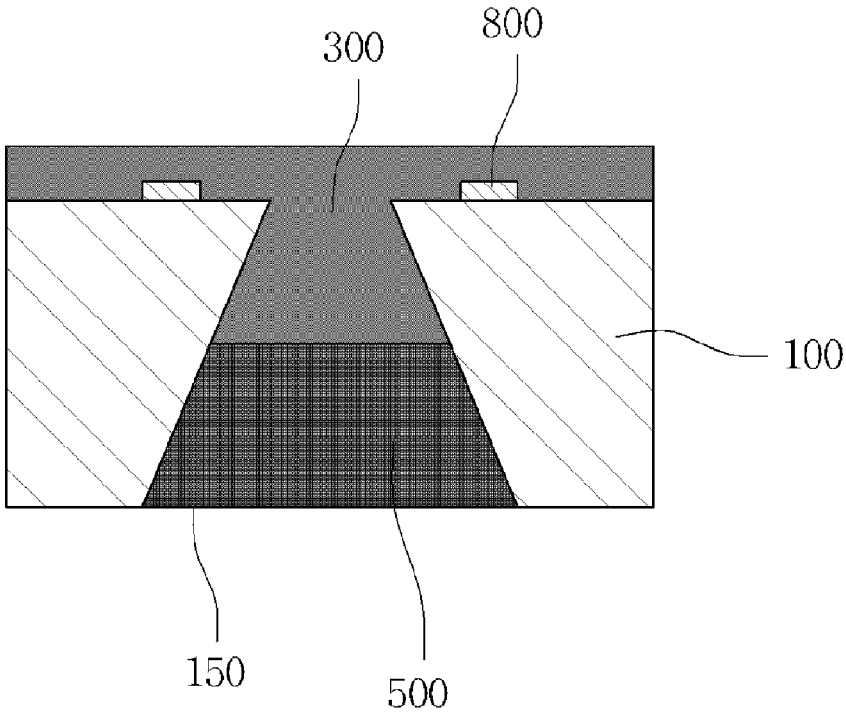
FIG. 8 is a sectional view illustrating a droplet receiver which further includes the flow control unit of the intercepting fluid layer.

In order to control the flow of the intercepting fluid layer 300, as shown in FIG. 8, a droplet receiver according to this embodiment may further include a flow control unit 800 at a predetermined position on the partition wall structure 100. The flow control unit 800 is used to measure and control the thickness, speed, and direction of the intercepting fluid layer 300.

Meanwhile, the intercepting fluid layer 300 may be formed through known technology which provides the flow of fluid, for example, through a device for forming a gas layer which is called an air-curtain. Herein, the detailed description of a device for forming the intercepting fluid layer 300 will be omitted.

Figure 9:
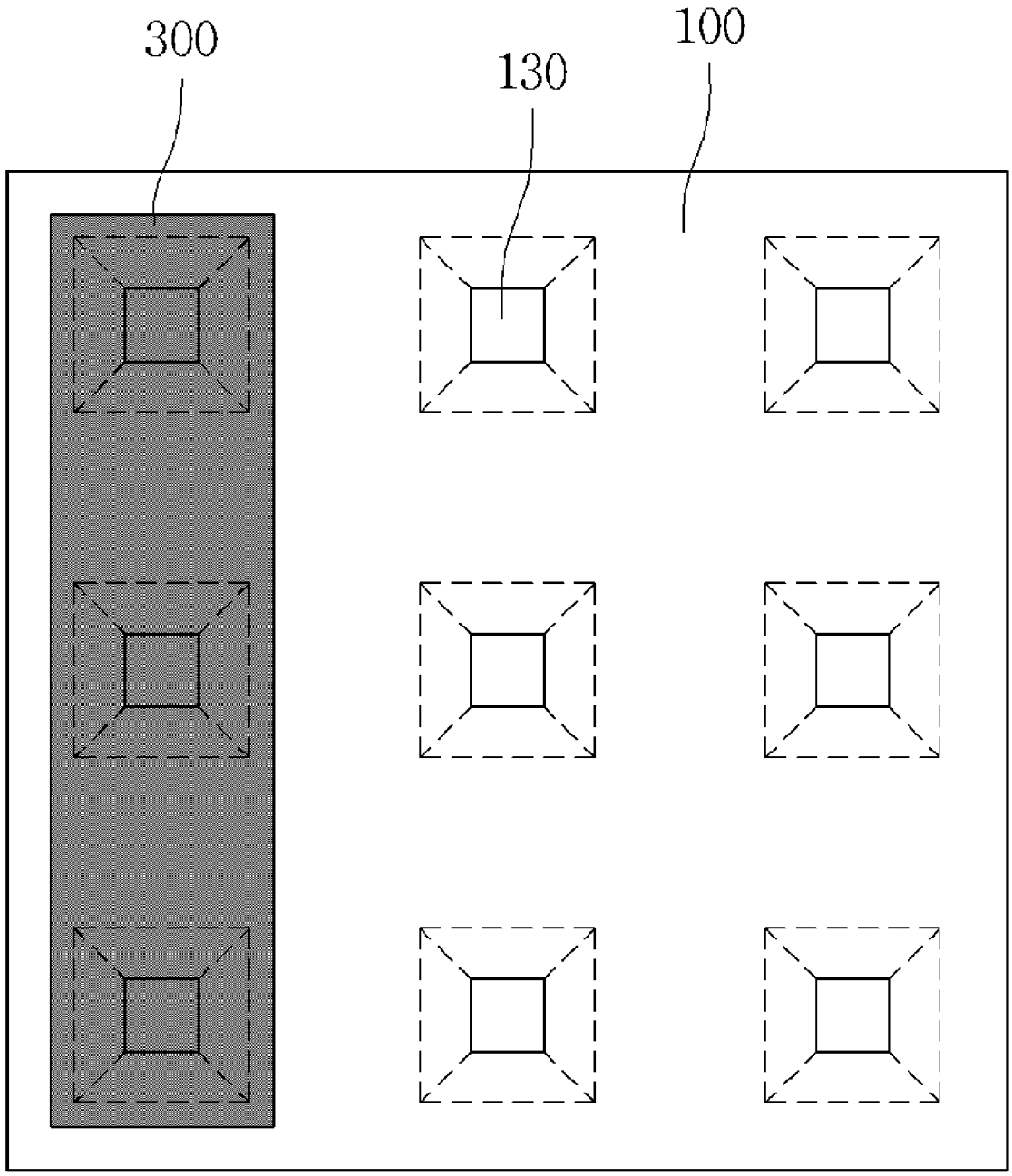
FIGS. 9 and 10 are views illustrating embodiments of partition wall structures to having a plurality of droplet receiving parts which share the intercepting fluid layer.
Figure 10:
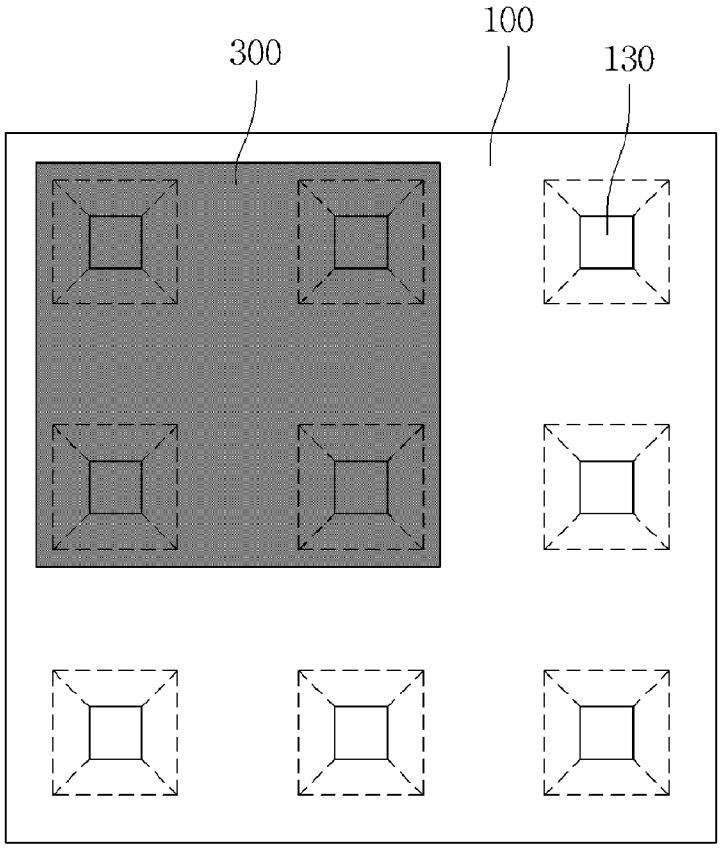

FIGS. 9 and 10 are views illustrating embodiments of partition wall structures 100 to each having a plurality of droplet receiving parts 500 sharing an intercepting fluid layer 300.

The intercepting fluid layer 300 may be individually formed in each droplet receiving part 500. As shown in FIG. 9, the plurality of droplet receiving parts 500 arranged in the same line may share the intercepting fluid layer 300. Further, as shown in FIG. 10, all droplet receiving parts 500 included in a predetermined area may share the intercepting fluid layer 300.

Figure 12:
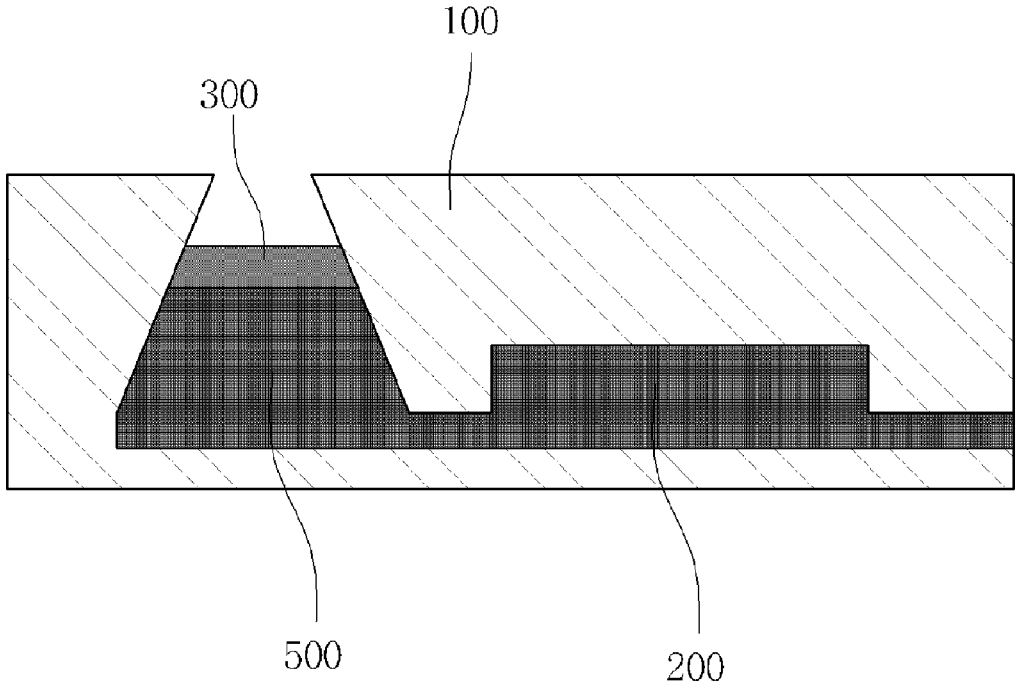
FIGS. 12 and 13 are sectional views illustrating droplet receivers each having a feed pipe which provides a course within which the droplets move.
Figure 13:
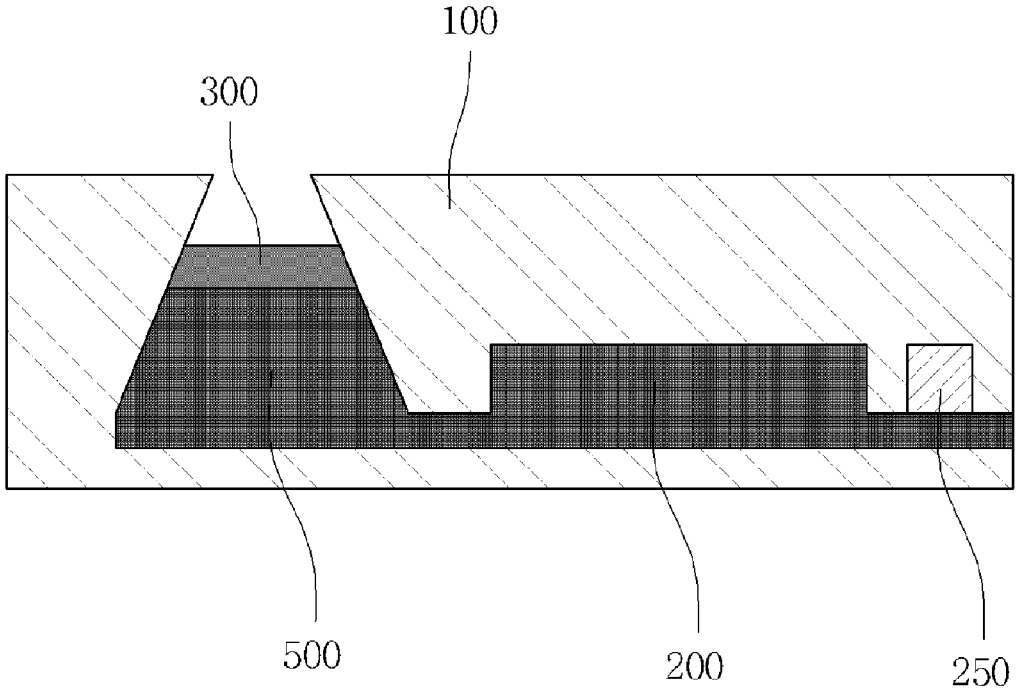

FIGS. 12 and 13 are sectional views illustrating droplet receivers each including a feed pipe 200 which provides a course within which droplets move.

As shown in FIG. 12, the droplet receiver constructed as described above may further include the feed pipe 200 for feeding received droplets 600. The feed pipe 200 is connected at one end thereof to the droplet receiving part 500, thus providing a course for feeding the droplets 600 received in the droplet receiving part 500 to another place.

Further, as shown in FIG. 13, a fluid feeding unit 250 may be provided on the feed pipe 200 to guide the movement of the droplets. The fluid feeding unit 250 may comprise a pump or valve.

The above-mentioned droplet receiver includes the internal space 110 which is formed so that its sectional area is reduced towards the input part 130, thus preventing the rebounding of droplets which enter the droplet receiving part 500. Further, the droplet receiver includes the intercepting fluid layer 300 for isolating the received droplets from the outside, thus preventing the contamination and volatilization of the droplets which are received in the droplet receiving part 500.

Figure 14:
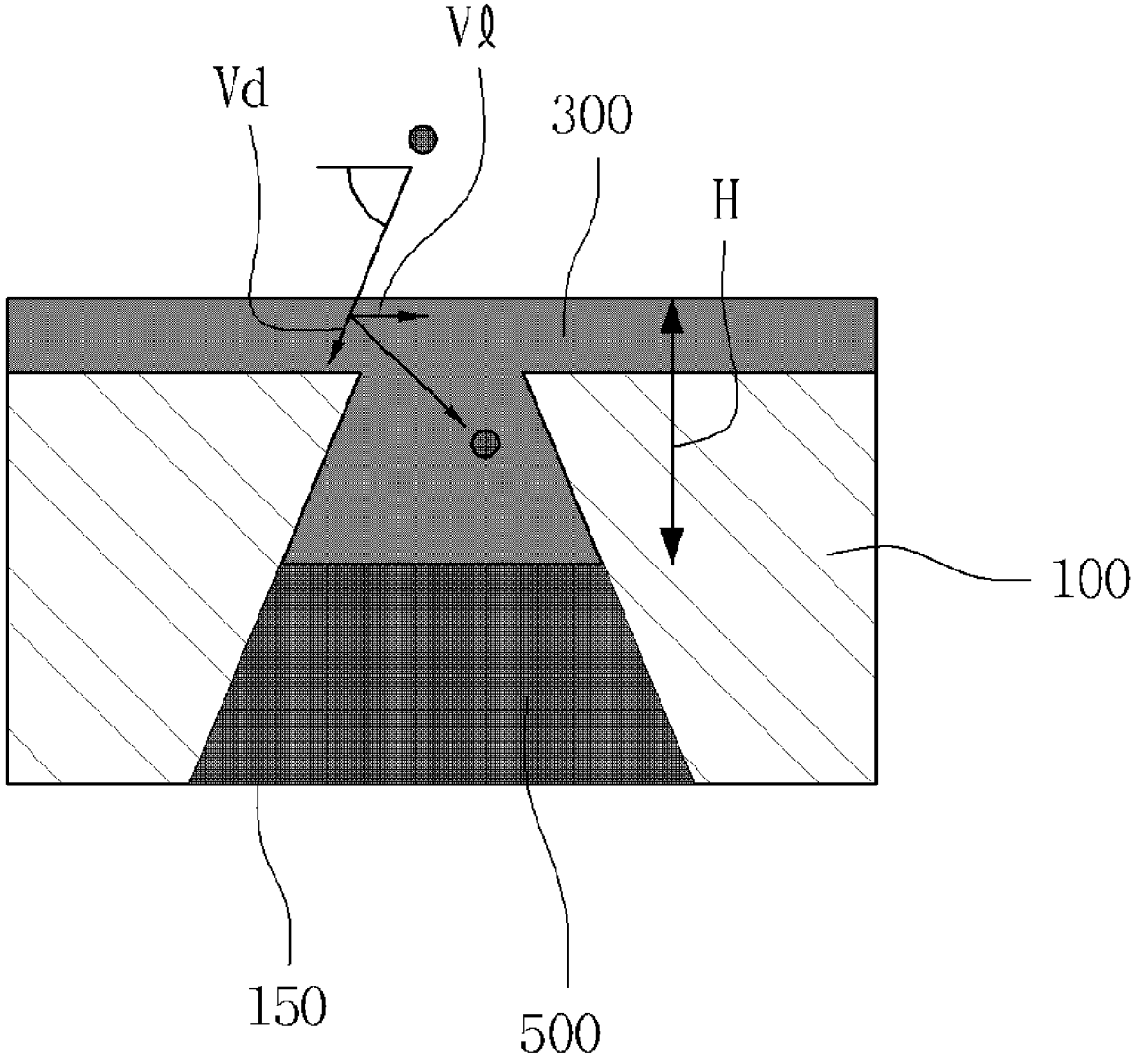
FIG. 14 is a view illustrating the method of receiving discharged droplets using the droplet receiver.

FIG. 14 is a view illustrating the method of receiving discharged droplets using the droplet receiver. The method of receiving droplets according to the preferred embodiment of the present invention will be described below with reference to the drawing.

First, the droplet receiver including the droplet receiving part 500 which is isolated from the outside by the intercepting fluid layer 300 having a flow is provided. Since the construction of the droplet receiver has been described in the above embodiments, duplicate description will be omitted herein.

Next, the droplets are put into the droplet receiving part 500. Since the droplet receiver according to this embodiment includes the intercepting fluid layer 300 having a flow, the droplets must be discharged in consideration of the thickness and speed of the intercepting fluid layer 300 so that the discharged droplets can be put into the droplet receiving part 500 having the narrow input part 130. As is known to those skilled in the art, the droplets are discharged with a predetermined direction and speed, so that the droplets are discharged in a predetermined direction at a predetermined speed, in consideration of the position of the input part 130 of the droplet receiving part 500 and the thickness and flow rate of the intercepting fluid layer 300.

Meanwhile, prior to discharging the droplets, a sample (e.g. an aqueous solution) for containing the discharged droplets may be filled in the droplet receiving part 500.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

As described above, the present invention provides a droplet receiver which includes an internal space formed such that its sectional area is reduced towards an input part, thus preventing the rebounding of droplets which enter a droplet receiving part, and which includes an intercepting fluid layer so as to isolate the received droplets from the outside, thus preventing droplets received in the droplet receiving part from being contaminated and volatilizing.

What is claimed is:

1. A droplet receiver, comprising:

a non rectangular partition wall structure having an internal space for receiving a droplet, and an input part for opening the internal space; and an intercepting fluid layer spaced apart from a bottom surface of the internal space in such a way as to be positioned inside or outside the internal space or to extend from an inside portion of the internal space to an outside portion thereof, wherein a droplet receiving part defined by the internal space and the intercepting fluid layer is isolated from an outside by the intercepting fluid layer.

2. The droplet receiver as set forth in claim 1, wherein the internal space is shaped such that a sectional area thereof is reduced towards the input part.

3. The droplet receiver as set forth in claim 1, wherein the intercepting fluid layer is a gas layer or a liquid layer which has a flow.

4. The droplet receiver as set forth in claim 1, further comprising:

a feed pipe connected at a first end thereof to the droplet receiving part, thus providing a course within which the droplet received in the droplet receiving part moves.

5. The droplet receiver as set forth in claim 4, further comprising:

a fluid feeding unit provided on the feed pipe.

6. The droplet receiver as set forth in claim 1, further comprising:

a flow control unit installed at a predetermined position on the partition wall structure so as to control the flow of the intercepting fluid layer.

7. A method of receiving a droplet, comprising:

providing a droplet receiver including a droplet receiving part which is isolated from an outside by an intercepting fluid layer which has a flow; and discharging a droplet in a predetermined direction at a predetermined speed in consideration of a position of an input part of the droplet receiving part and a flow rate of the intercepting fluid layer so as to put the droplet into the droplet receiving part.

* * * * *